US007426764B2

(12) United States Patent
Ekins

(10) Patent No.: US 7,426,764 B2
(45) Date of Patent: Sep. 23, 2008

(54) CIRCULATION ENHANCING SLEEVE PILLOW OR CUSHION

(76) Inventor: David Ekins, 1042 E. Fort Union Blvd., #224, Midvale, UT (US) 84047

( * ) Notice: Subject to any disclaimer, the term of this patent is extended or adjusted under 35 U.S.C. 154(b) by 291 days.

(21) Appl. No.: 11/202,934

(22) Filed: Aug. 12, 2005

(65) Prior Publication Data

US 2006/0070183 A1 Apr. 6, 2006

Related U.S. Application Data

(60) Provisional application No. 60/522,084, filed on Aug. 12, 2004.

(51) Int. Cl.
*A47C 20/00* (2006.01)
*A47G 9/10* (2006.01)

(52) U.S. Cl. ..... 5/640; 5/643; 5/646; 5/652; 5/657

(58) Field of Classification Search ..... 5/630, 5/636, 638, 640, 643, 646, 648, 652.1, 657, 5/491; 2/16
See application file for complete search history.

(56) References Cited

U.S. PATENT DOCUMENTS 924,893 A * 6/1909 Dodridge ..... 5/491
3,883,906 A * 5/1975 Sumpter ..... 5/632
4,173,048 A 11/1979 Varaney
5,163,194 A 11/1992 Dixon
5,579,551 A * 12/1996 Tommaney ..... 5/636
5,604,944 A * 2/1997 Meade ..... 5/643
5,644,809 A 7/1997 Olson
5,644,810 A 7/1997 Kato
5,708,998 A 1/1998 Torbik
6,041,458 A * 3/2000 Vickers et al. ..... 5/636
6,052,848 A 4/2000 Kelly
6,095,894 A 8/2000 Stevens
6,273,866 B2 8/2001 Thomas et al.
6,415,466 B1 7/2002 Laiso
6,581,226 B1 6/2003 Brustein
6,685,024 B1 * 2/2004 Matthews ..... 206/521
7,216,387 B2 * 5/2007 Laxton ..... 5/636

* cited by examiner

*Primary Examiner*—Michael Trettel
(74) *Attorney, Agent, or Firm*—Clayton, Howarth & Cannon, P.C.

(57) ABSTRACT

A tubular-shaped, circulation-enhancing pillow or cushion device worn on any part of upper or lower extremities as a rest and/or sleep aid. The device may include a semi ridged, yet flexible and resilient tubular core, a soft fabric elastic liner and an outer cushioned tension wrap. The device may allow one to instinctively change sleeping postures, while remaining asleep or while resting, whether laying in a supine, prone, side or upright position. The device may isolate the part of an extremity that would otherwise have a tendency to become numb, achy or "fall asleep" due to pressure exerted from above by one's resting head, torso, knee, ankle, or other overlying body part, while at the same time act as a pillow or cushion to the overlying body part at rest.

49 Claims, 8 Drawing Sheets

CIRCULATION ENHANCING SLEEVE PILLOW OR CUSHION

CROSS-REFERENCE TO RELATED APPLICATIONS

This application claims the benefit of U.S. Provisional Application No. 60/522,084, filed Aug. 12, 2004, which is hereby incorporated by reference herein in its entirety, including but not limited to those portions that specifically appear hereinafter, the incorporation by reference being made with the following exception: In the event that any portion of the above-referenced provisional application is inconsistent with this application, this application supercedes said above-referenced provisional application.

STATEMENT REGARDING FEDERALLY SPONSORED RESEARCH OR DEVELOPMENT

Not Applicable.

BACKGROUND

1. The Field of the Invention

The present disclosure relates generally to cushioning devices, and more particularly, but not necessarily entirely, to pillows or cushions that may be worn as sleeves over arm or leg extremities.

2. Description of Related Art

There has been proposed a multitude of devices with the objective of improving a person's comfort while at rest or sleep. Diverse and often contradictory devices have been devised and proposed. A host of mattresses, ornamental, therapeutic, and cervical pillows, supportive cushions, and other devices are known relating to the physical comfort of a person at sleep or rest.

Most of these devices claim to enhance the sleeping experience by imposing a specific, often ridged, sleep posture. However, to an extent, they each fail to provide for the normal and regular occurrence that, as reported by researchers, adult subjects change their position of sleep between 3 and 36 times per night. This change of position frequently places an arm or shoulder underneath the head or part of the torso, impeding the normal circulation of blood in the arms and causing them to "fall asleep" or become numb. Similarly, pressure from an upper leg may cause a lower leg, knee or ankle to become numb by impeding its normal circulation of blood. Some of the known prior art devices to date, seek to prevent or limit the normal and regular change in sleep postures, resulting in people fighting against or abandoning these "sleep aids" during their sleep.

Most therapeutic and cervical pillows focus on the position of the head and neck when sleeping, thereby forcing the sleeper into a supine, unmovable position. Other pillows accommodate a side sleeping posture and attempt to enhance arm and shoulder circulation by carving channels into the pillow itself thus limiting or isolating contact with the head or torso, which would impede extremity circulation. Such a method, however, forces the person into a restricted, fixed posture and hampers the normal and routine changes in sleep posture.

Some devices known in the art include open frame pillow and head support systems which may address arm circulation issues and accommodate some sleep posture changes. However, such systems relegate the person's posture to a few structured positions within, and sometimes against, the framework of the support structure.

Other known cushioning devices include block-like pillows which accommodate arm circulation and changing positions, but are often dependent upon reconfiguring the cushions to a self imposed ridged sleep posture, presenting the drawback of being impossible to reconfigure while sleeping.

Still other devices known in the art provide for elevating one or both arms, but do not address the circulation restriction problem of an arm lying beneath the head or torso.

Other known cushioning devices provide an ergonomic pillow assembly utilized to provide relaxing comfort and rest to a person having an upper torso problem with pain through the head, neck, and spinal regions. Such devices may provide for normal arm circulation, but like other devices, may disadvantageously impose a very specific sleep posture.

Accordingly, several features and advantages of the present disclosure are provided to enhance a person's comfort during sleep, or while at rest, giving them the freedom to move extremities at will, without depriving the protected (sleeved) portions of the extremities of vascular flow or circulation and without forcing a preconceived and inflexible "sleep posture".

An additional feature of the present disclosure is that the device may be used as a companion pillow while resting or sleeping in a "cuddle posture," where one person is in the supine position with an arm stretched out perpendicular to the body to enable the head of another person to use the arm as a pillow.

Another feature of the present disclosure is to use the assembled device as a unique support pillow under the back of the neck (cervical spine) when sleeping in the supine position. This may make for an ideal small portable pillow, which may also be useful in traveling, backpacking or camping.

Another feature of the present disclosure is to provide a device that may fit over one's knee to take the place of, or augment a pillow, frequently placed between the knees while laying horizontally on one's side, commonly used to relieve back strain or discomfort. The added advantage being that the lower knee's circulation (in a horizontal plane) may not be impeded by the upper knee or leg. Nor, if used singularly (without a conventional pillow) would there be a need to re-adjust the conventional pillow's position when changing sleep posture.

Another feature of the present device is to allow medical magnets to be incorporated within the device for pain therapy.

Also, the present device may be used as a sun bathing aid. Many sunbathers strive for an even tan on the sides of their body as well as their front and back. Worn over the arm, underneath the body, on or above the biceps muscle, the head can comfortably be placed on the device, acting as a cushion for the head. Since the body, primarily the head, may be covering the device there may be no interference from the device in blocking the rays of the sun. Additionally, since the materials used to construct the device may absorb very little water, suntan oil or other substances and can be easily cleaned, neither the device's function or its aesthetics may be materially compromised.

Another feature of the present disclosure is that the device may be worn at any location on either the upper or lower extremities as a protection guard worn during sports activities to help cushion and disperse the effect of an impact. Since the device can be virtually sized for any part of the upper or lower extremities, and the stretchable liner may allow the device to easily slip to the desired position on the arm or leg, yet retain its place at the desired position, it may be ideal for a quick on/off protection guard.

Still another feature of the present disclosure is that the device may be configured as a tapered cylinder, with a wider circumference to fit over the shoulder and a smaller circumference to bear against the upper arm. This device may include a cut out for under the arm, allowing the wider circumference to fit higher over the shoulder.

Another feature of the present disclosure is that the device may be sized to fit around the wrist and worn as a support aid for the wrist and hand while keyboarding or other similar activity to help prevent or lessen the effects of carpal tunnel syndrome, wherein the sleeved wrist could rest on an object and maintain normal circulation.

It will also be understood that another feature of the present disclosure is that the present device may be constructed of a material that may be quite buoyant. Accordingly, the device may be used as a non-inflatable, partial flotation appliance worn high over the biceps muscles of each arm or around each thigh of the legs, or both, to improve the buoyancy of the body and minimize or eliminate treading water, or as an aid in learning to swim, or for water sport activities.

In accordance with the present disclosure, a sleeve cushion or pillow may comprise an adjustable semi-flexible cylindrical core, encased by a woven or knitted fabric liner and wrapped around the external circumference with a flexible cushion. The device may enable normal circulation to any portion of an upper or lower extremity that would otherwise be compromised by the weight of one's head, torso, or other body part bearing down, while providing a pillow-like effect for the overlying bearing body part.

The prior art is thus characterized by several disadvantages that are addressed by the present disclosure. The present disclosure minimizes, and in some aspects eliminates, the above-mentioned failures, and other problems, by utilizing the methods and structural features described herein.

The features and advantages of the disclosure will be set forth in the description which follows, and in part will be apparent from the description, or may be learned by the practice of the disclosure without undue experimentation. The features and advantages of the disclosure may be realized and obtained by means of the instruments and combinations particularly pointed out in the appended claims.

BRIEF DESCRIPTION OF THE DRAWINGS

The features and advantages of the disclosure will become apparent from a consideration of the subsequent detailed description presented in connection with the accompanying drawings in which.

DETAILED DESCRIPTION

Figure 1:
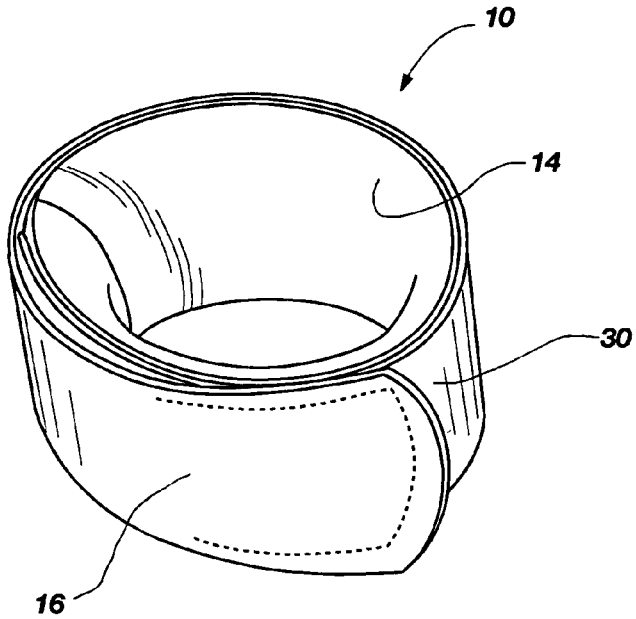
FIG. 1 is a perspective view of one embodiment of a cushioning device made in accordance with the principles of the present disclosure.

For the purposes of promoting an understanding of the principles in accordance with the disclosure, reference will now be made to the illustrative embodiments portrayed in the drawings and specific language will be used to describe the same. It will nevertheless be understood that no limitation of the scope of the disclosure is thereby intended. Any alterations and further modifications of the inventive features illustrated herein, and any additional applications of the principles of the disclosure as illustrated herein, which would normally occur to one skilled in the relevant art and having possession of this disclosure, are to be considered within the scope of the disclosure claimed.

Before the present structure and methods regarding a circulation enhancing pillow or cushion are disclosed and described, it is to be understood that this disclosure is not limited to the particular configurations, process steps, and materials disclosed herein as such configurations, process steps, and materials may vary somewhat. It is also to be understood that the terminology employed herein is used for the purpose of describing particular embodiments only and is not intended to be limiting since the scope of the present disclosure will be limited only by the appended claims and equivalents thereof.

It must be noted that, as used in this specification and the appended claims, the singular forms "a," "an," and "the" include plural referents unless the context clearly dictates otherwise. Moreover, as used herein, the terms "comprising," "including," "containing," "characterized by," and grammatical equivalents thereof are inclusive or open-ended terms that do not exclude additional, unrecited elements or method steps.

As referred to herein, the term "loop" shall be construed broadly to include various shapes, including round and non-round shapes, and shall not be limited to closed shapes such that the loop may have a beginning and an end.

The term "semi-rigid" as used herein shall be construed broadly to include materials that have adequate strength or rigidity to support a body member without collapsing, yet the materials are flexible to form a loop and deflect under the force of the body member.

Figure 2:
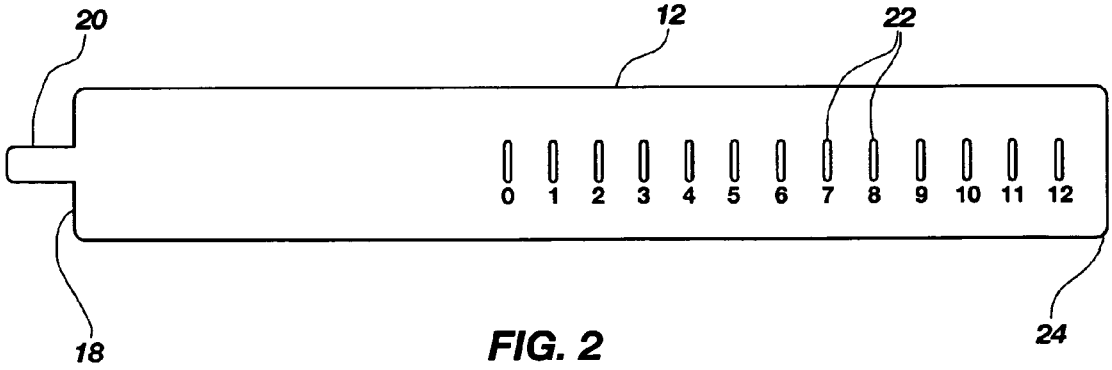
FIG. 2 is a plan view of a core of the cushioning device of FIG. 1.

Referring now to FIG. 1, a perspective view is shown of one embodiment of a cushioning device, indicated generally at 10. The cushioning device may include a core 12, as best shown in FIG. 2, a liner 14 for covering the core 12, and a wrap 16 including a cushioning material for covering the liner 14.

In one embodiment of the present disclosure, the core 12 may provide a combination of the proper rigidity to the cushioning device 10 to assure that the cushioning device 10 may not easily collapse over the extremity or body member on which it is worn, thus aiding proper circulation, yet the core 12 may be flexible enough such that it will be comfortable to rest on with the head, torso or overlying extremity. The core 12 may also be resilient such that the core 12 may be able to flex repeatedly without breaking. The core 12 may therefore be configured to form a loop for receiving a body member therethrough. It will be understood that the term "core" as used herein shall not be limiting in terms of size, shape or configuration.

The liner 14 may be made of a woven or knitted fabric incorporating nylon or polypropylene and elastane, for example, to provide for enough elasticity to stretch around and enclose the core 12 and also provide a wick effect to absorb perspiration and accommodate airflow between the extremity and the core 12. The wrap 16 may function to suppress any expansion of the core 12 and the inner diameter of the liner 14, and may act as a cushion for providing comfort to the body part which may be applying a downward force against the device 10.

One exemplary material choice for constructing the core 12 may be polyethylene. The polyethylene material may be formed as a high-density polyethylene (HDPE) sheet material with a density rating of 0.95 and a thickness of 0.057 inches (plus or minus 5%) die cut or stamped out 3.25 inches wide by 24 inches in length overall, for example. It will be understood, however, that the core 12 may be formed of other materials having different properties and dimensions within the scope of the present disclosure.

As illustrated in FIG. 2, one end of the core 12 may have cutouts 18, of 1.25 inches×1.25 inches, for example, from both edges of width of the core 12, thereby forming a tongue 20. The tongue 20 may measure 0.75 inches in width and may project 1.25 inches in length. It will be appreciated that other embodiments may have cutouts 18 and tongues 20 of other dimensions, or some embodiments may not have cutouts 18 or tongues. The tongues 20 may be configured to bend and fit into a slot 22 formed in the core 12. One embodiment of the present disclosure may include a plurality of slots 22, such as thirteen slots 22, which may be centered on the core 12, and sized 0.85 inches×0.12 inches and spaced in 1 inch increments from the end of the core 12 opposite the tongue 20. The slots 22 may have a typical radius of 0.04 inches, for example. Each of the outside corners 24 of the core 12 may have a typical radius of 0.13 inches, for example. The core 12 may be formed from a sheet of material through a single process by a custom made punch or die. Accordingly, the features of the core, including the length and width as well as the cutouts 18 leaving the tongue 20, the slots 22 and rounded corners 24 can be easily formed. It will be appreciated that the core 12 and the features of the core 12 may have other dimensions, and that other embodiments may not include all the features discussed above, or the core 12 may have additional features. Moreover, the core 12 may be formed using different techniques within the scope of the present disclosure.

In one aspect of the present disclosure, the tongue 20 may be inserted into a slot 22 on an interior or concave side of a loop formed by the core 12. Accordingly excess portions of the core 12 may wrap around an outside of the loop and slide freely, thus avoiding, to a significant extent, a double wall effect and increased stiffness that would otherwise take place if the excess core material were fastened to the loop and not allowed to slide. This arrangement may provide a more flexible loop. It will be understood, however, that as the size of the loop is reduced, the loop formed by the core 12 may become more rigid. However, additional windings of the cushioning wrap 16 are possible with smaller sized loops such that the device 10 may continue to provide a suitable cushion even in small diameter configurations of the device 10.

One embodiment of the core 12 may be formed of an HDPE material which, when extruded, may have a matt finish and have a "corona" treatment, or other such treatment to ensure that any ink silk screening, foil or heat-stamping of any logos, trademarks, instructions or numerical references, adhere to the core 12. The printing or stamping of such references can be accomplished in the same or separate operation as the stamp-out of the HDPE material. Alternatively, the core 12 can be cut out by hand or machined, or an infinite combination of cut and/or machined and/or punched and/or stamped processes.

Alternatively, the core 12 may be formed of any other material that can be repeatedly bent without fracturing and provide for similar flexibility and rigidity characteristics as the HDPE referenced above, such as, metal, vinyl, nylon, rubber, various impregnated or laminated fibrous materials, various plasticized materials, cardboard, paper, plastic or composite bands, for example.

Moreover, other embodiments of the core 12 may employ a variety of alternative fastening systems which may use suitable materials such as magnetic or stiff adhesive tape, cut for proper size and flexibility, or any variety of clips, clamps or fastening mechanisms, for example.

It will also be understood that in alternative embodiments of the present disclosure, the core 12 may be a fixed (non-adjustable) cylindrical band. Such core 12 may be composed of metal, plastic or composite pipe sections, woven wire mesh, wire or stiffening slats imbedded into a molding media forming a circular band or of high density foam, for example.

Figure 3:
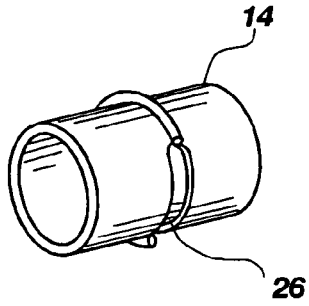
FIG. 3 is a perspective view of a liner of the cushioning device of FIG. 1.
Figure 4:
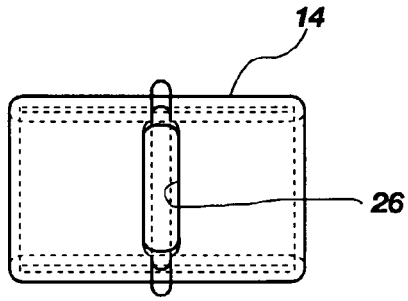
FIG. 4 is a plan view of the liner of FIG. 3.
Figure 12:
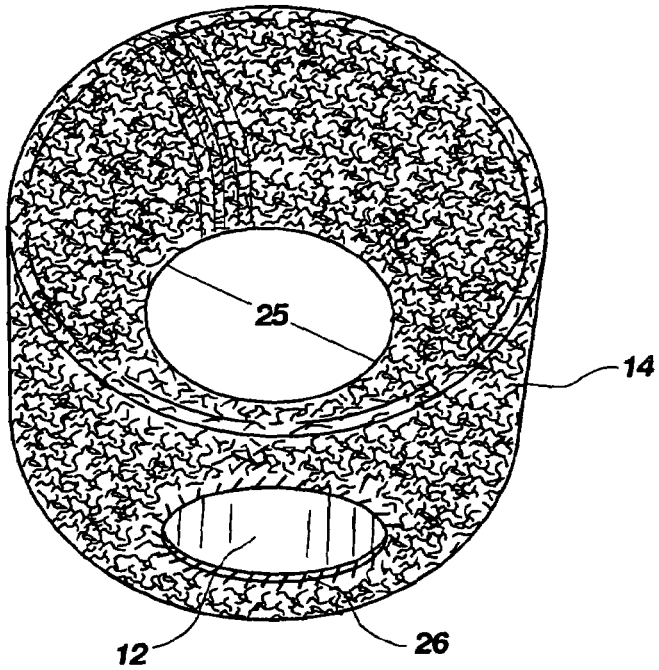
FIG. 12 is another perspective view of the core and liner of FIG. 8, with the liner completely encompassing the core, demonstrating a smaller diameter of the lined core.

The liner 14, as shown most clearly in FIGS. 3 and 4, may be constructed of materials that may provide enough elasticity to stretch around and enclose the core 12 at its maximum diameter adjustment, and yet not unduly sag when the diameter of the core 12 is in its smallest configuration. The material may be soft to the touch so as to provide comfort against the skin. Also, the liner 14 may provide a "wick effect" to absorb any perspiration produced from the skin. Additionally, the liner 14 may have the appropriate tension and weave sufficient to allow for the flow of air between skin of the extremity and the core 12. Once the liner 14 encompasses the core 12, the liner 14 may provide a smaller, yet flexible inner diameter 25, as shown in FIG. 12, allowing an extremity to be placed through the inside diameter 25 of the liner clad core 12 such that the liner's tension and fabric enables the device 10 to retain its position wherever placed on the extremity. One exemplary embodiment of the liner 14 may be formed of a woven, stretchable fabric blend consisting of 70% nylon and 30% elastane, for example. The material may be woven so that it may be capable of stretching to 300%, for example, of original size without damage in both length and width. The fabric may be formed and knitted into a tube shape and when removed from the manufacturing knitting cylinder, the knitted tube may have an inside diameter of 1.9 inches, for example. One embodiment of the liner 14 may be sized such that a thickness of an inner wall plus an outer wall of the woven or knitted tube of the liner 14 may be nominally 3/16 inches, for example. The fabric tube material may be cut approximately 9 inches in length and if required, turned so the softest surface of the fabric may be facing outside. The tube may then be folded in half lengthwise such that the tube ends may be aligned and overlap each other so the ends of the tube can be joined together, such as by sewing or serging, to form a hollow ring. The tube may be joined all around the liner 14 with the exception of an opening or grasping hole 26. One embodiment of the grasping hole 26 may be sized approximately 1.3 inches (plus or minus 0.1 inches), for example. The joining or serging process may be configured to ensure that threads at the edges of the opening 26, the portion that prevents the tube from connecting continuously, do not become unstitched during stretching and use.

Alternative embodiments of the liner 14 may include stretchable nylon, elastic, polypropylene, cotton or any other yarn or fabric that may be sufficiently stretchable both longitudinally and latitudinally to fit over the core 12 at maximum adjustment, and yet be taut with no undue sagging when the core 12 is adjusted to the minimum diameter. Moreover, a desirable characteristic of the material for the liner may be that it may be contact compatible with skin. As an example, the liner 14 may be made from a woven blend of fabric made from 95% polypropylene and 5% spandex. Due to the different stretching characteristics of this woven blend, however, the opening 26 may be increased in size measuring from 1.75 inches to 2 inches, for example. Similarly, dimensional changes may need to be calculated to accommodate any given stretchable blend of fabric.

Figure 5:
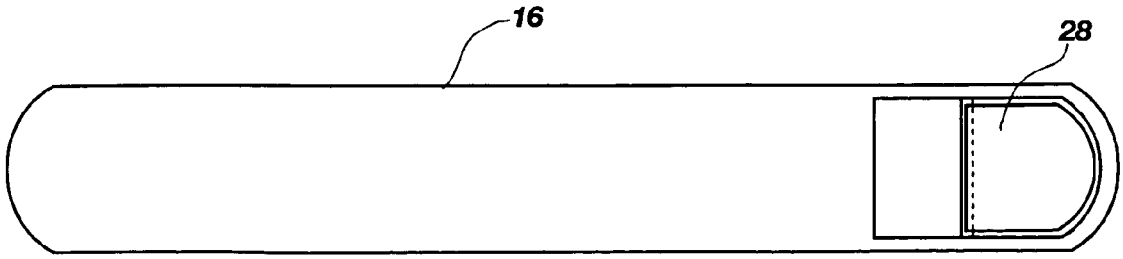
FIG. 5 is a plan view of a wrap of the cushioning device of FIG. 1.
Figure 6:
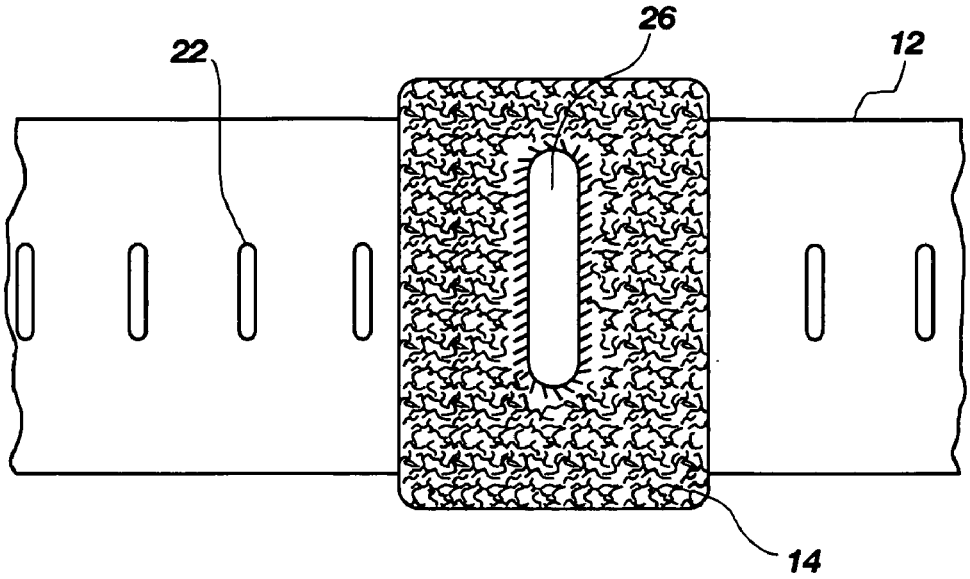
FIG. 6 is a plan view of a liner placed partially on a core.
Figure 7:
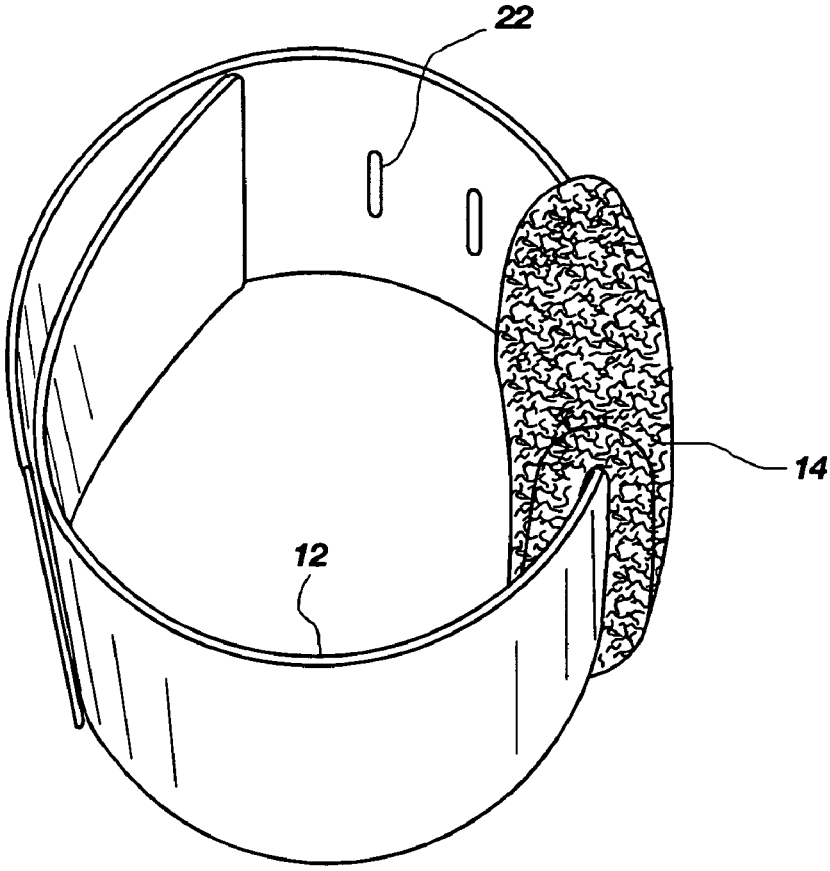
FIG. 7 is a perspective view of the core of FIG. 6 fastened in a loop.
Figure 8:
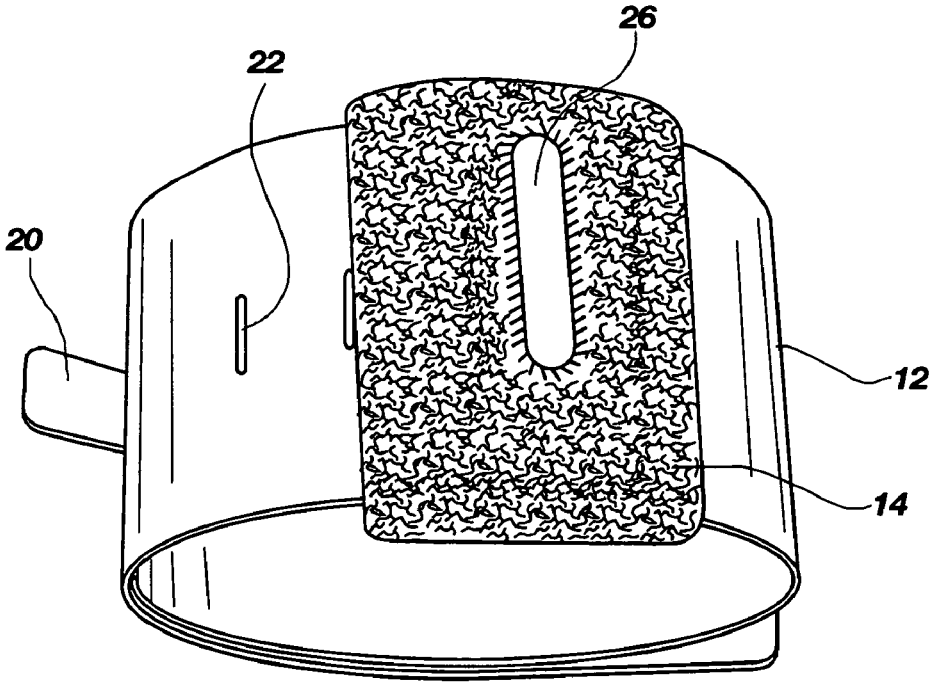
FIG. 8 is an additional perspective view of the core and liner of FIG. 7.
Figure 9:
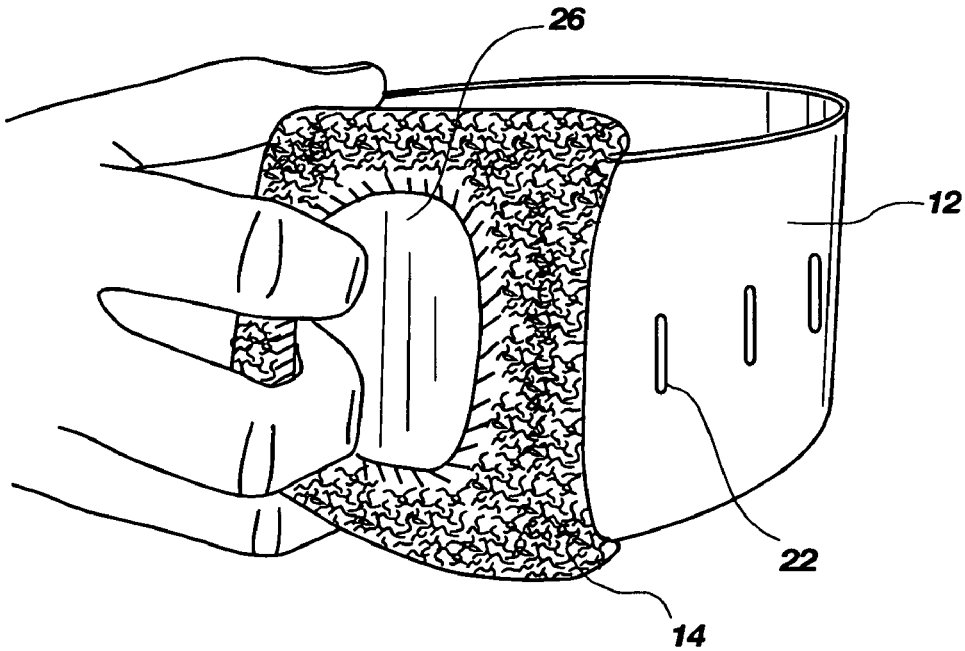
FIG. 9 is a perspective view of the core and liner of FIG. 8, with the liner being stretched over the core with fingers placed in one side of a "grasping hole" of the liner.
Figure 10:
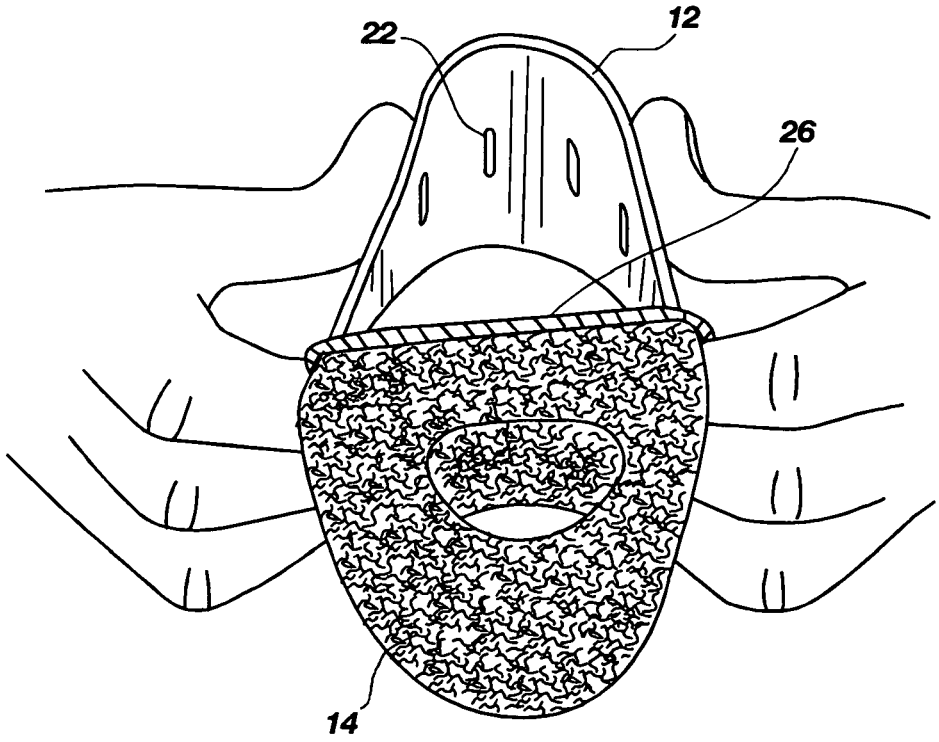
FIG. 10 is a perspective view of the core and liner of FIG. 8, with the liner being stretched over the core beyond the step shown in FIG. 9.
Figure 11:
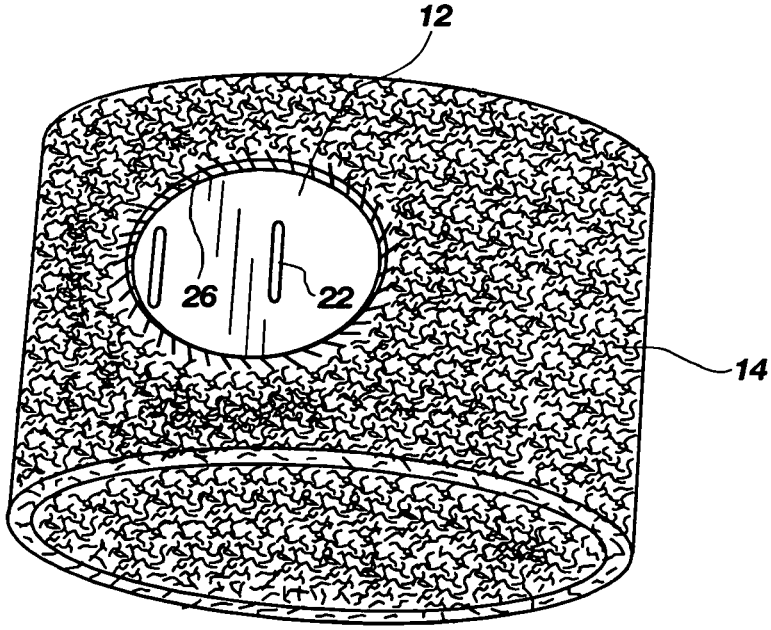
FIG. 11 is a perspective view of the core and liner of FIG. 8, with the liner completely encompassing the core.

In addition to the core 12 and the liner 14, one embodiment of the device 10 may also include an outer tension wrap 16. The wrap 16 may function to prevent the core 12 from expanding to a larger diameter or ellipse, suppress lateral movement of the opening 26 in the liner 14, and act as a cushion providing comfort to an overlying body part applying downward force against the device 10. Additionally, the wrap 16 may serve to act as a fine tuning adjustment, regulating the degree of flexibility/stiffness of the underlying core 12, depending upon how tightly the wrap 16 is wrapped. FIGS. 1 and 5, illustrate a wrap 16, which may be made from 4 mm polychloroprene, laminated by a hook compatible fabric on the top side and nylon backing on the underneath side. The wrap 16 may measure 3.5 inches wide and 23 inches in length and may have a radius of 2.07 inches on each end, for example. This laminated polychloroprene may be fastened by Velcro® or other brand hook and loop fabric to accommodate a variety of core 12 diameters. The "hook" material 28 may be sewn on the nylon (underneath) side of the loop fabric 30, facing downward, such that when the laminated polychloroprene is stretched around the core 12 and liner 14 to the desired tension and the wrap 16 completes a revolution, the wrap 16 may attach onto itself. Wrapping the outer tension wrap 16 loosely may enhance flexibility and decrease rigidity to the assembled device 10, whereas wrapping it with more tension may have the opposite effect.

Alternative configurations of the outer tension wrap may involve a number of foam like, fabric clad materials either open cell or closed cell, capable of stretching around the core 12 and liner 14. Such alternative materials may include ethylene vinyl acetate, polyethylene foam, latex foam products, flexible polyurethane (memory foams), chiorprene rubber, styrene butediene, flexible polyether and polyester polyurethane. Likewise, the wrap 16 may be constructed of a dynamic or static air bladder wrap or flexible gel cell material, or any other suitable material known in the art.

Assembly of the cushioning device 10 will now be described with particular reference to FIGS. 1 and 6-12. Progressive assembly of the device 10 is shown FIGS. 6-12, whereas the completed assembly of the device 10 is shown in FIG. 1.

The device 10 may be provided to users in a partially assembled condition with the liner 14 slipped over the core 12 as shown in FIG. 3. It will also be understood that the device 10 may be provided to users completely unassembled, or completely assembled. For sizing to fit over an arm, the user may hold the core 12 under his/her arm and with his/her free hand, bend the tongue portion 20 around the arm and align with a desired slot 22, such as the slot 22 representing the smallest possible diameter and then expand the diameter by two slots, for example. The slots 22, may be numbered, such as 0-12 for reference, for example. The user may make a mental note of the slot reference number, remove the core 12 from the arm and then slide the tongue 20 out through the selected slot 22 and wrap the excess portion of the core 12 around the outside, sliding the liner 14 over the loose end to hold the core 12 in a coiled configuration. The user may then insert his/her fingers from both hands in the small opening 26 on the outside of the liner 14 (see FIG. 9) and clamping the core 12 together with thumbs (see FIG. 10), pull the liner 14 until it substantially completely encompasses the core 12 (see FIG. 11). The liner 14 may then be stretched over the core 12 evenly making a "doughnut" shape, and the user may pull the edges of the opening 26, to make the opening 26 as small as possible. Finally, the wrap 16 may be stretched around the circumference of the liner clad core 12 with the desired tension, and fastened to itself by virtue of the hook-loop fastening system, as shown in FIG. 1.

Sizing to fit over a forearm, wrist, ankle, knee or other parts of an arm or leg may be accomplished in much the same way. The plurality of slots 22 on the core 12, the elastic liner 14, and the outer tension wrap 16 may accommodate inside diameters incrementally for various sizes, ranging from approximately 3 to 7 inches, for example.

Figure 13:
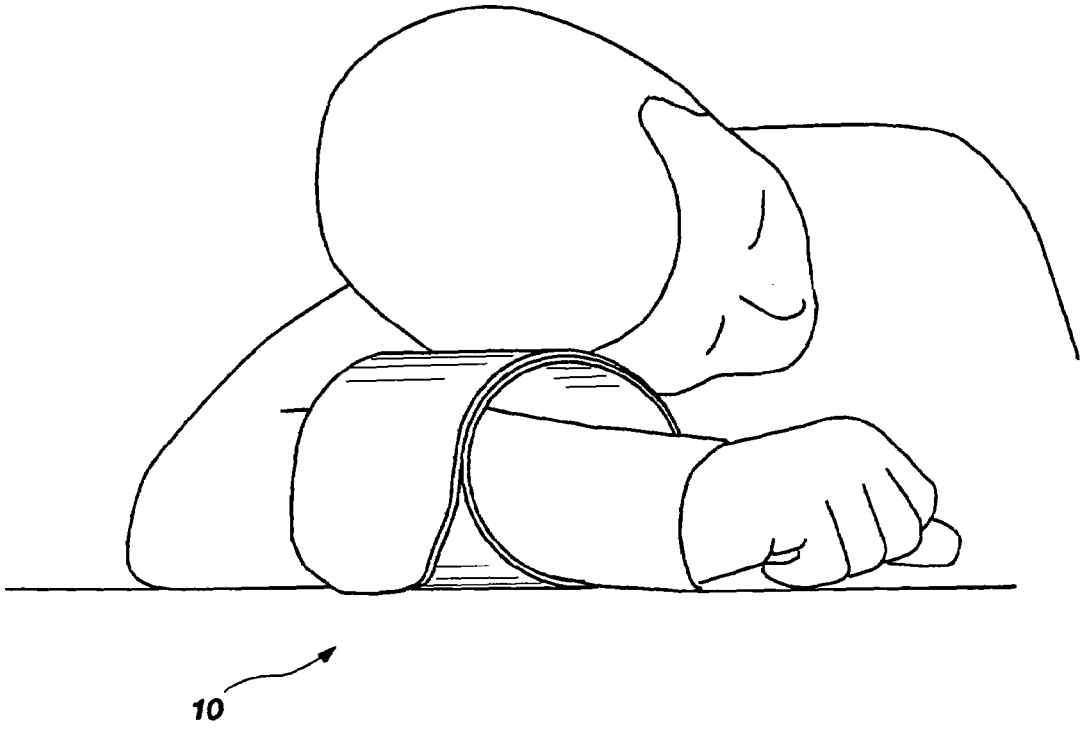
FIG. 13 is a perspective view of the cushioning device in one of several different possible uses.

As shown in FIG. 13, which shows a perspective view of the cushioning device 10 in one of several different possible uses, an extremity or body member such as the arm, may be placed in the loop formed by the device 10. The liner 14 may be used to hold the device 10 in place on the body member, and a user's head, for example, may be placed on the cushioning device 10. The core 12 within the cushioning device 10 may deflect and the wrap 16 may also provide a soft support for the user's head.

It will be understood that the present disclosure may provide numerous advantages. For example, the design and materials employed in the device 10 may enable a user to adjust the device 10 to virtually any part of an arm or leg extremity ranging from less than approximately 3 inches in diameter to up to 7 inches, for example. The device 10 may also be dimensioned to accommodate smaller or larger dimensions as well. The device 10 may be easily assembled in just a few non-complicated steps requiring the mere use of hands. The materials chosen for the liner 14 may not only have the elasticity to stretch over the size range of the device 10, but may be pleasant to be in contact with the skin, promoting air circulation and also acting as a wick in absorbing any perspiration. Additionally, the liner 14 may be sized so that its tension allows the liner 14 to slide over the arm or leg extremity, yet the liner 14 may allow the device 10 to stay in place without another attaching apparatus. The material chosen for the core 12, with the specific density, resilience, thickness and size, when adjusted properly, may provide for uninterrupted circulation of an extremity that would otherwise be restricted by that portion of the body bearing down on the extremity while the user is at sleep or rest. Yet the core 12 may not be unduly ridged to become uncomfortable for the overlying body part. The material chosen for the outer tension wrap 16 may provide a maximum cushion effect, yet its longitudinal elasticity and fastening system may allow one to "fine-tune" the device 10 for the desired rigidity and flexibility.

Figure 14:
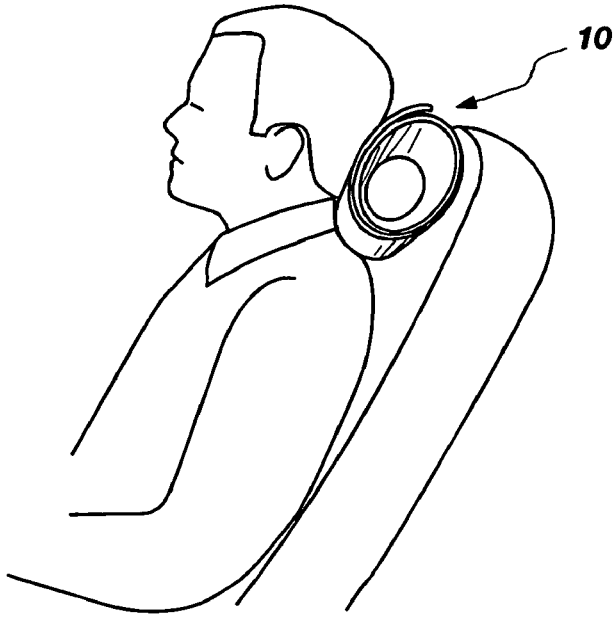
FIG. 14 is a perspective view of the cushioning device in another of several different possible uses.

An additional embodiment for use of the cushioning device 10 is to use the device 10 as a unique support pillow to be placed under the back of the neck (cervical spine) when sleeping in the supine position or when sitting in an upright position when leaning against a tall back rest or other vertical object, as shown in FIG. 14. In this configuration, the device 10 may be normally configured to a small diameter to fit the curvature of the cervical spine. This embodiment may be especially useful when traveling in confined spaces, or the device 10 may be used as a primary pillow when camping or hiking. It will be understood that the device 10 may be provided in various different widths, and that the device 10 having an increased width may be desirable for some purposes, such as for use as a primary pillow when camping or hiking.

Another embodiment of use for the device 10 is that the device 10 may be used as a sun bathing aid. Many sunbathers strive for an even tan on the sides of their body as well as their front and back. The device 10 may be worn over the arm, on or above the biceps muscle, such that the head can comfortably be placed on the device 10 and the device 10 may act as a cushion for the head. Since the body, such as the head, may be covering the device 10 there may be no interference from the device 10 in blocking the rays of the sun. Additionally, since the material used to construct the device 10 may absorb very little water or suntan oil and can be easily cleaned, neither the device's function or its aesthetics may be materially compromised.

Another embodiment of the device 10 may incorporate medical magnets for pain therapy. This may be accomplished using a flexible strip of medical magnets incorporated beneath the outer tension wrap 16 of the device 10, or between the core 12 and the outermost liner 14 layer. Such incorporation may not substantially impede the comfort of the device 10, nor its ability to allow for normal circulation, yet the medical magnetic field will pass through the core 12 and onto that portion of the extremity desired. Adjusted properly, the device 10 may hold the medical magnetic field in place at the chosen location.

A further embodiment of the device 10 may be sized to fit around the wrist and worn as a support aid for the wrist and hand while keyboarding or other similar activity to help prevent or lessen the effects of carpal tunnel syndrome, wherein the sleeved wrist could rest on an object and maintain normal circulation in the wrist and hand.

Yet an additional embodiment of the device 10 may be worn at any location on either the upper or lower extremities as a light-weight protection guard worn during sports activities to help cushion and disperse the effect of an impact. Since the device 10 can be virtually sized for any part of the upper or lower extremities, and the stretchable liner 14 may allow it to easily slip to the desired position on the arm or leg, yet retain its place at the desired position, the device 10 may be ideal for a quick on/off protection guard.

Another embodiment of the device 10 may include a modification in the width of the core 12 to include a broader dimension to accommodate the size of a shoulder. In this configuration the core 12 may include a tapered cylinder appearance, with the wider circumference to fit over the shoulder and the smaller circumference to bear against the upper arm, which would, in turn, hold the device 10 in place. This configuration may include a cut out for under the arm, allowing the wider circumference to fit higher over the shoulder and give enhanced circulation characteristics for the vascular system of the shoulder region.

Another use of the device 10, since both the outer tension wrap 16 and core 12 may be quite buoyant, is to use the device 10 as a partial flotation appliance worn high over the biceps muscles of each arm or around each thigh of the legs, or both, to improve the buoyancy of the body and minimize or eliminate treading water, or as an aid in learning to swim, or for water sport activities.

Figure 15:
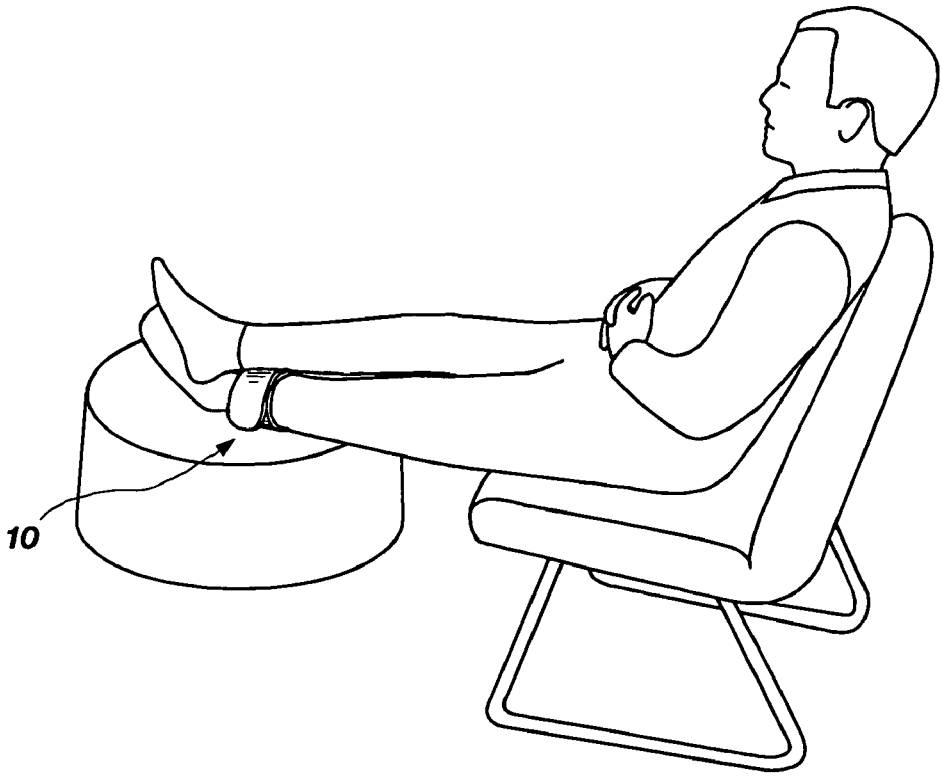
FIG. 15 is a perspective view of the cushioning device in yet an additional use of several different possible uses.

It will also be understood that the device 10 may be used by inserting one hand through the device 10, or both hands through the device 10 at opposing ends such that the device 10 may be used as a pillow for resting one's head on a desk while sitting, for example. Moreover, the device 10 may be placed on the lower ankle to support a leg while crossing legs while feet are on an ottoman or footstool, for example, as shown in FIG. 15.

Another use for the device 10 may be as a companion pillow while resting or sleeping in a "cuddle posture," where one person is in the supine position with an arm stretched out perpendicular to the body to enable the head of another person to use the arm as a pillow. As with other uses, the device 10 may ensure normal circulation to the wearer's arm, but, in this case, the device 10 may provide for a pillow or cushion effect for the companion's head. In the event the wearer elects to rest or sleep in a side position while still providing an outstretched arm for the companion to rest upon, one device 10 can be worn high on the arm protecting and cushioning that portion of the extremity, and a second device 10 can be worn on the forearm or wrist ensuring circulation to the lower portion of the extremity, while at the same time, providing an improved cushion for the companion. As with other cases, the circulation-enhancing sleeve device 10 may be used as the only pillow or cushion, or may be used in tandem with a conventional pillow or pillows directly on top of the device 10.

Accordingly, it will be understood that the circulation-enhancing sleeve device 10 may provide the first known comfort device, which acts like a pillow in one respect, yet provides for normal, continuous circulation when worn over an arm or leg, and moves effortlessly with the person during each movement, or ever-changing sleep postures.

Figure 16:
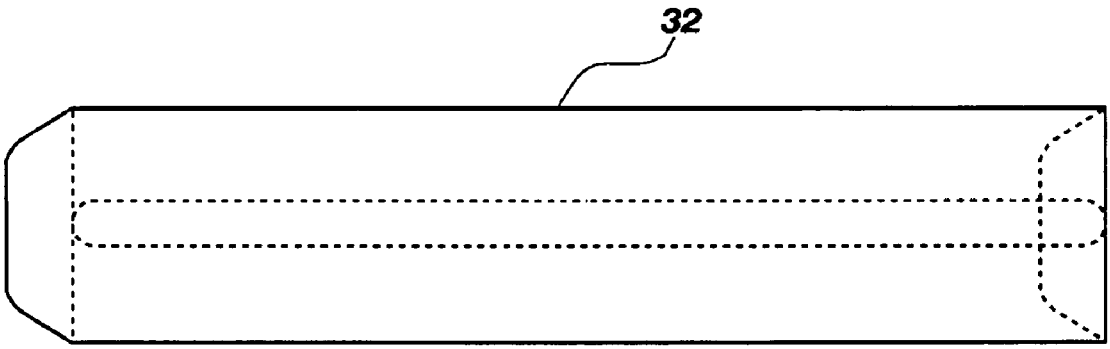
FIG. 16 is a plan view of one embodiment of a package used to store and ship the device.

Another feature of the present disclosure is that the device 10 may be easily assembled or disassembled such that the device may be easily packaged and shipped to customers. In one embodiment, the device 10 may be stored or shipped to customers in a package 32, as shown in FIG. 16. The package 32 may be a long flat paper package, formed of 0.02 inch thick white coated box stock, for example, having dimensions configured to receive the core 12 and wrap 16 when the core 12 and wrap 16 are arranged in a flat configuration. For example, one embodiment of the package may be dimensioned approximately twenty-four inches long by 5.5 inches wide. However, it will be appreciated that the package 32 may be formed of other materials and have any other dimensions suitable for containing or shipping the device 10. For example, other embodiments of the package 32 may be formed of a transparent or translucent material such that the device 10 may be visible through the package 32.

Although the description above contains many specific details, these should not be construed as limiting the scope of the disclosure but as merely providing illustrations of some of the presently disclosed embodiments of the disclosure. For example, the method of adjustability, fastening, as well as a variety of substitute components may be valid substitutes for the disclosed embodiments. Moreover, it will be understood that some embodiments of the present disclosure may be used without the liner 14. Other embodiments may be used without the wrap 16. Some embodiments of the present disclosure may include cushioning material integral with the core 12 or liner 14, and other embodiments may include the liner 14 integral with the core 12 or the wrap 16.

It will be appreciated that the structure and apparatus disclosed herein is merely one example of a means for forming a loop, and it should be appreciated that any structure, apparatus or system for forming a loop which performs functions the same as, or equivalent to, those disclosed herein are intended to fall within the scope of a means for forming a loop, including those structures, apparatus or systems for forming a loop which are presently known, or which may become available in the future. Any structure or structures which function the same as, or equivalently to, a means for forming a loop falls within the scope of this element.

It will be appreciated that the structure and apparatus disclosed herein is merely one example of a means for lining a loop, and it should be appreciated that any structure, apparatus or system for lining a loop which performs functions the same as, or equivalent to, those disclosed herein are intended to fall within the scope of a means for lining a loop, including those structures, apparatus or systems for lining a loop which are presently known, or which may become available in the future. Any structure or structures which function the same as, or equivalently to, a means for lining a loop falls within the scope of this element.

It will be appreciated that the structure and apparatus disclosed herein is merely one example of a means for cushioning, and it should be appreciated that any structure, apparatus or system for cushioning which performs functions the same as, or equivalent to, those disclosed herein are intended to fall within the scope of a means for cushioning, including those structures, apparatus or systems for cushioning which are presently known, or which may become available in the future. Any structure or structures which function the same as, or equivalently to, a means for cushioning falls within the scope of this element.

It will be appreciated that the structure and apparatus disclosed herein is merely one example of a means for supporting a cushioning material in a loop, and it should be appreciated that any structure, apparatus or system for supporting which performs functions the same as, or equivalent to, those disclosed herein are intended to fall within the scope of a means for supporting a cushioning material in a loop, including those structures, apparatus or systems for supporting a cushioning material in a loop which are presently known, or which may become available in the future. Any structure or structures which function the same as, or equivalently to, a means for supporting a cushioning material in a loop falls within the scope of this element.

In accordance with the features and combinations described above, a useful method of cushioning a body member may include the steps of:

(a) providing a cushioning device having an adjustable loop size for receiving the body member therethrough; and (b) inserting the body member through the loop such that when the cushioning device covers a portion of a body member and pressure is applied to the cushioning device, the cushioning device supports the pressure to allow circulation of blood in the body member.

Those having ordinary skill in the relevant art will appreciate the advantages provide by the features of the present disclosure. For example, it is a feature of the present disclosure to provide a cushioning device that is simple in design and manufacture, and economical to purchase. Another feature of the present disclosure is to provide such a cushioning device that may be adjustable to fit on the vast majority of user's extremities. It is a further feature of the present disclosure, in accordance with one aspect thereof, to provide a cushioning device that is easy to assemble and adjust. It is another feature of the present disclosure to provide a cushioning device that slides effortlessly over a selected area of either upper or lower extremities. It is a further feature of the present disclosure to provide a cushioning device that may be comfortable to wear, allowing the device to maintain a desired position while providing ample air circulation. It is an additional feature of the present disclosure to provide a cushioning device that may be easily maintained and cleaned. It is another feature of the present disclosure to provide a cushioning device that can be used for numerous purposes, such as a light-weight athletic guard, a small cervix pillow, a portable pillow for hiking or camping, for use in providing comfortable support while sunbathing, or for providing a flotation device.

In the foregoing Detailed Description, various features of the present disclosure are grouped together in a single embodiment for the purpose of streamlining the disclosure. This method of disclosure is not to be interpreted as reflecting an intention that the claimed disclosure requires more features than are expressly recited in each claim. Rather, as the following claims reflect, inventive aspects lie in less than all features of a single foregoing disclosed embodiment. Thus, the following claims are hereby incorporated into this Detailed Description by this reference, with each claim standing on its own as a separate embodiment of the present disclosure.

It is to be understood that the above-described arrangements are only illustrative of the application of the principles of the present disclosure. Numerous modifications and alternative arrangements may be devised by those skilled in the art without departing from the spirit and scope of the present disclosure and the appended claims are intended to cover such modifications and arrangements. Thus, while the present disclosure has been shown in the drawings and described above with particularity and detail, it will be apparent to those of ordinary skill in the art that numerous modifications, including, but not limited to, variations in size, materials, shape, form, function and manner of operation, assembly and use may be made without departing from the principles and concepts set forth herein.

What is claimed is:

1. A cushioning device comprising:

a core comprising an elongate member formed of a flexible material;

a liner comprising an elastic material for removably covering said core; and a wrap for surrounding at least a portion of said liner and said core, said wrap comprising a cushioning material;

wherein said cushioning device is configured such that when said core covers a portion of a body member and pressure is applied to said wrap, said core supports said wrap to allow circulation of blood in said body member.

2. The cushioning device of claim 1, wherein said elongate member comprises a tongue on an end thereof, and a plurality of slots for receiving said tongue such that said core is configured for forming an endless loop for receiving said body member therethrough.

3. The cushioning device of claim 2, wherein said endless loop is substantially cylindrical.

4. The cushioning device of claim 1, wherein said core forms an endless loop for receiving said body member therethrough, said endless loop being adjustable in size.

5. The cushioning device of claim 1, wherein said core comprises a semi-rigid, resilient material.

6. The cushioning device of claim 1, wherein said liner forms a hollow ring for receiving said core therein.

7. The cushioning device of claim 6, wherein said hollow ring comprises an opening for allowing removable attachment of said liner to said core.

8. The cushioning device of claim 1, wherein said liner is formed of a fabric material capable of wicking moisture away from said body member, and allowing airflow to said body member.

9. The cushioning device of claim 1, further comprising a package for storing or shipping said core, said liner and said wrap in a substantially flat configuration.

10. The cushioning device of claim 1, wherein said wrap has an elongate shape configured for encompassing said core and said liner.

11. The cushioning device of claim 1, wherein said wrap comprises attachment means for removably attaching said wrap to said core.

12. The cushioning device of claim 11, wherein said attachment means for removably attaching said wrap to said core comprises hook and loop fasteners.

13. A cushioning device comprising:

a core for forming an endless loop for receiving a body member therethrough, said endless loop being adjustable in size;

a liner removably attachable to said core for covering said core; and a wrap for surrounding said liner and said core, said wrap comprising a cushioning material.

14. The cushioning device of claim 13, wherein said core comprises a tongue on an end thereof and a plurality of slots for receiving said tongue to thereby allow said endless loop to be adjustable.

15. The cushioning device of claim 13, wherein said core comprises a semi-rigid, resilient material.

16. The cushioning device of claim 13, wherein said liner forms a hollow ring for receiving said core therein.

17. The cushioning device of claim 16, wherein said hollow ring comprises an opening for allowing removable attachment of said liner to said core.

18. The cushioning device of claim 13, wherein said wrap has an elongate shape configured for encompassing said core and said liner.

19. The cushioning device of claim 13, wherein said wrap comprises attachment means for removably attaching said wrap to said core.

20. A cushioning device comprising:

a core forming an endless loop for receiving a body member therethrough;

wherein said loop is configured to be adjustable in size for receiving body members of variable sizes; and a wrap for surrounding said core, said wrap comprising an elongate cushioning material configured to encompass said endless loop, said wrap further comprising attachment means for removably attaching said wrap to said core.

21. The cushioning device of claim 20, further comprising a liner comprising an elastic material for removably covering said core.

22. The cushioning device of claim 21, wherein said liner forms a hollow ring for receiving said core therein.

23. The cushioning device of claim 22, wherein said hollow ring comprises an opening for allowing removable attachment of said liner to said core.

24. The cushioning device of claim 20, wherein said core comprises a tongue on an end thereof, and a plurality of slots for receiving said tongue to thereby allow said endless loop to be adjustable.

25. The cushioning device of claim 20, wherein said core comprises a semi-rigid, resilient material.

26. The cushioning device of claim 20, wherein said attachment means for removably attaching said wrap to said core comprises hook and loop fasteners.

27. A cushioning device comprising:

a core comprising an elongate member having a tongue on an end thereof and a plurality of slots for receiving said tongue such that said core is configured for forming an endless loop for receiving a body member therethrough;

a cushioning material disposed around at least a portion of a circumference of said core; and further comprising a liner comprising an elastic material for removably covering said core.

28. The cushioning device of claim 27, wherein said cushioning material forms part of a wrap having an elongate shape configured for encompassing said core and said liner.

29. The cushioning device of claim 28, wherein said wrap comprises attachment means for removably attaching said wrap to said core.

30. The cushioning device of claim 29, wherein said attachment means for removably attaching said wrap to said core comprises hook and loop fasteners.

31. A cushioning device comprising:

a core comprising an elongate member having a tongue on an end thereof and a plurality of slots for receiving said tongue such that said core is configured for forming an endless loop for receiving a body member therethrough;

a cushioning material disposed around at least a portion of a circumference of said core; and wherein said liner forms a hollow ring for receiving said core therein.

32. The cushioning device of claim 31, wherein said hollow ring comprises an opening for allowing removable attachment of said liner to said core.

33. A cushioning device comprising:

a core for forming a loop for receiving a body member therethrough; and a liner comprising an elastic material forming a hollow ring for receiving said core therein, said hollow ring comprising an opening for allowing removable attachment of said liner to said core; and further comprising a wrap for surrounding at least a portion of said liner and said core.

34. The cushioning device of claim 33, wherein said wrap comprises a cushioning material.

35. The cushioning device of claim 33, wherein said core comprises a tongue on an end thereof, and a plurality of slots for receiving said tongue.

36. The cushioning device of claim 33, wherein said core forms an endless loop for receiving said body member therethrough, said endless loop being adjustable in size.

37. The cushioning device of claim 33, wherein said core comprises a semi-rigid, resilient material.

38. The cushioning device of claim 33, wherein said liner is formed of a fabric material capable of wicking moisture away from said body member.

39. The cushioning device of claim 33, wherein said liner is formed of a fabric material capable of allowing airflow to said body member.

40. The cushioning device of claim 33, wherein said wrap has an elongate shape configured for encompassing said core and said liner.

41. The cushioning device of claim 33, wherein said wrap comprises attachment means for removably attaching said wrap to said core.

42. A cushioning device comprising:

means for forming a flexible, semi-rigid loop such that said loop is configured to deflect to support the weight of a body member;

means for lining said loop for contacting a body extremity when said body extremity is placed in said loop; and means for cushioning said loop against the body member.

43. The cushioning device of claim 42, wherein said means for forming a loop comprises a core.

44. The cushioning device of claim 43, wherein said core comprises a tongue on an end thereof, and a plurality of slots for receiving said tongue.

45. The cushioning device of claim 42, wherein said means for lining said loop comprises a hollow ring for receiving said means for forming a loop therein.

46. The cushioning device of claim 45, wherein said hollow ring comprises an opening for allowing removable attachment of said means for lining to said means for forming a loop.

47. The cushioning device of claim 42, wherein said means for cushioning said loop comprises a wrap having an elongate shape configured for encompassing said means for forming a loop.

48. The cushioning device of claim 42, wherein said means for cushioning said loop comprises attachment means for removably attaching said means for cushioning to said means for forming a loop.

49. The cushioning device of claim 48, wherein said attachment means comprises hook and loop fasteners.

* * * * *